US005944236A

United States Patent [19]

Cinque

[11] Patent Number: 5,944,236

[45] Date of Patent: Aug. 31, 1999

[54] CLOTHING CLIP APPARATUS

[76] Inventor: Richard Cinque, 141B S. El Camino Real, Ste. 175, Encinitas, Calif. 92024

[21] Appl. No.: 08/379,011

[22] Filed: Jan. 11, 1995

[51] Int. Cl.[6] ..... A41H 43/00; A41F 1/00

[52] U.S. Cl. ..... 223/1; 223/DIG. 2; 24/537; 24/515; 24/503

[58] Field of Search ..... 223/85, DIG. 1, 223/DIG. 2, DIG. 4; 24/536, 537, 515, 503, DIG. 24

[56] References Cited

U.S. PATENT DOCUMENTS

| | | | |
|---|---|---|---|
| D. 234,204 | 1/1975 | Miller et al. . | |
| D. 264,662 | 6/1982 | Bisk et al. . | |
| 1,770,298 | 7/1930 | Canniff | 24/343 |
| 2,014,061 | 9/1935 | Anderson | 223/DIG. 4 |
| 2,408,344 | 9/1946 | Scurrah . | |
| 2,583,784 | 1/1952 | Maccaferri . | |
| 2,666,240 | 1/1954 | Maccaferri . | |
| 3,100,324 | 8/1963 | Tutino et al. . | |
| 3,289,877 | 12/1966 | Wolf . | |
| 3,292,223 | 12/1966 | Esposito . | |
| 3,346,927 | 10/1967 | Tompkins | 24/DIG. 29 |
| 3,456,262 | 7/1969 | Coon . | |
| 3,698,607 | 10/1972 | Batts . | |
| 3,720,979 | 3/1973 | Krawagna . | |
| 3,767,092 | 10/1973 | Garrison et al. . | |
| 3,774,267 | 11/1973 | Sheider . | |
| 3,923,213 | 12/1975 | George et al. . | |
| 3,950,829 | 4/1976 | Cohen | 24/503 |
| 4,012,811 | 3/1977 | Mazzarerro . | |
| 4,308,981 | 1/1982 | Miura | 24/537 |
| 4,335,858 | 6/1982 | Cranna . | |
| 5,234,139 | 8/1993 | Korenstein . | |
| 5,440,791 | 8/1995 | Guio . | |

FOREIGN PATENT DOCUMENTS

| | | | |
|---|---|---|---|
| 186530 | 1/1936 | Switzerland | 24/536 |

*Primary Examiner*—Bibhu Mohanty
*Attorney, Agent, or Firm*—Knobbe, Martens, Olson & Bear, LLP.

[57] ABSTRACT

An apparatus for clipping two or more articles of clothing, such as socks, together. The apparatus includes two jaw members which are hingeably attached and a securing member that has two arms which are respectively positioned in two channels in the two jaw members. The securing member is slidable between a closed position, where it urges the two jaw members inward to thereby securely clamp the two articles of clothing therebetween, and an open position where one of the arms is not engaged with one of the jaw members allowing the jaw members to be separable to permit removal of the two articles of clothing. The apparatus includes a latch mechanism comprised of a ridge in one of the channels and a lip in the corresponding arm which engage to retain the securing member in the closed position. The apparatus is used to keep articles of clothing together during washing and drying.

4 Claims, 6 Drawing Sheets

CLOTHING CLIP APPARATUS

BACKGROUND OF THE INVENTION

1. Field of the Invention

The present invention relates to a device which is used to couple two articles of clothing together and, in particular, concerns a device which couples a pair of socks together during washing to eliminate the need to sort the socks and to prevent a loss of one of the socks.

2. Description of the Related Art

Washing articles of clothing and, in particular, multiple pairs of socks is a common, often weekly, occurrence in many households. One difficulty associated with washing articles of clothing such as socks, is that, after the washing and drying has been completed, the clothing has become jumbled and a significant amount of time must be spent sorting and matching the clothing. This is a particular problem with washing socks as there are often multiple pairs of similar, but not identical socks, that must be sorted and matched after each wash.

Another difficulty that arises when washing socks is that one of the socks in a pair may not be found after the washing has been completed. The unmatched sock can't generally be worn and it is often placed aside. Subsequently, when and if the lost sock reappears, the previously unmatched sock often cannot be found. Hence, there is an ongoing problem of socks becoming lost in the wash and ultimately not being rematched into a pair.

One tongue-in-cheek explanation of the phenomenon of the lost sock is that there is a void or entity living in either the washing machine or the dryer which absorbs one sock of a pair and thereby generates the unmatched sock. Statistical and anecdotal evidence tends to suggest that the void or entity exists in the dryer. One possible solution to the above problem would therefore be to not dry socks after they have been washed. However, most people prefer not to wear wet socks due to their clammy and cold nature. Further, wet socks, especially sweat socks, are notorious for their highly unpleasant odors and the negative environmental effect of many people wearing wet socks could be catastrophically substantial.

Another possible solution to the problems of matching articles of clothing, particularly after washing, is to attach the articles of clothing together using a clip or a safety pin. However, a safety pin can be difficult to use and has sharp edges which can cause injuries to the person attaching and detaching the articles of clothing to and from the safety pin. There are also disadvantages to having metal articles such as pins tumbling in the dryer.

In the prior art, other devices for attaching articles of clothing have been developed; however, none of these devices have been specifically developed to address the problems associated with washing matched articles of clothing and socks. For example, U.S. Pat. No. 3,767,092 discloses a hanger that has a locking clip designed to retain the clothing on the hanger. While this device can be used to attach articles of clothing to a hanger, this device cannot be placed into a washing machine as the hanger portion is too large.

Hence, there is a need in the prior art for a device which can be used to attach articles of clothing, like a pair of socks, to each other prior to washing and maintain the articles of clothing together during washing and drying. Preferably, this apparatus should be easy to manipulate so that the device can be quickly coupled to and removed from the articles of clothing.

SUMMARY OF THE INVENTION

The aforementioned needs are satisfied by the clothing clip apparatus of the present invention which includes two jaw members that are hingeably attached to each other and are configured to clasp two or more articles of clothing. A securing mechanism is attached to the two jaws of the clothing clip so that the securing mechanism can secure the two jaws in a closed configuration where the articles of clothing are securely clasped between the jaws. Further, the securing mechanism can also be manipulated by a user into a released configuration where the jaws can be separated to allow for removal of the clothing from the clothing clip. Preferably, the clip is in combination with two articles of clothing (e.g., socks) grasped in the jaws.

In the preferred embodiment, the securing mechanism comprises a generally U-shaped member which is slidably engaged with the jaw members so that the U-shaped member can be slid between an open position and a closed position. In the closed position, the securing member slides down over the outer surfaces of the two jaw members so that the inner surfaces of the two jaw members are urged towards each other. In the open position, the securing member is positioned so that one leg of the U-shaped member is disengaged from one of the jaw members thereby allowing the jaw members to be separated.

Further, in the preferred embodiment, a first leg of the U-shaped member also includes a first surface that engages with a ridge on the outer surface of one of the jaw members to latch the securing member in the closed position. Preferably, the first surface extends inwardly towards the jaw member and the ridge on the jaw member extends outwardly from the upper surface of the jaw member so that the first surface catches with the ridge so as to prevent the securing member from sliding into the open position. The securing member is preferably made of a deformable material so that the user of the device can deform the securing member so that the first surface disengages with the ridge when the user wishes to move the securing member from the closed to the open position.

In another feature of the preferred embodiment, the second leg of the U-shaped securing member is captured within a slide path that includes an opening. The second leg of the U-shaped member is captured within the opening so that the securing member can slide between the open and closed position but cannot be completely detached from the two hingeably connected jaws.

In yet another feature of the preferred embodiment, a hook, configured to hook onto a hanger, is attached to the top portion of the securing member. A pair of socks can then be hung on a hanger or clothes line either to dry or to be stored in conjunction with a matching clothing outfit.

Hence, the clothing clip apparatus provides a device which can be used in a method of the present invention to securely couple two articles of clothing, like matched socks, together prior to laundering. The clothing clip and the articles of clothing can then be washed and dried without the articles of clothing separating. After the clothing has been laundered, the articles of clothing can be stored coupled together with the clothing clip prior to use. The clothing clip is also configured to be easily removed when a person desires to wear the articles of clothing.

These and other objects and features of the present invention will become more fully apparent from the following description and appended claims taken in conjunction with the accompanying drawings.

DETAILED DESCRIPTION OF THE PREFERRED EMBODIMENT

Figure 1:
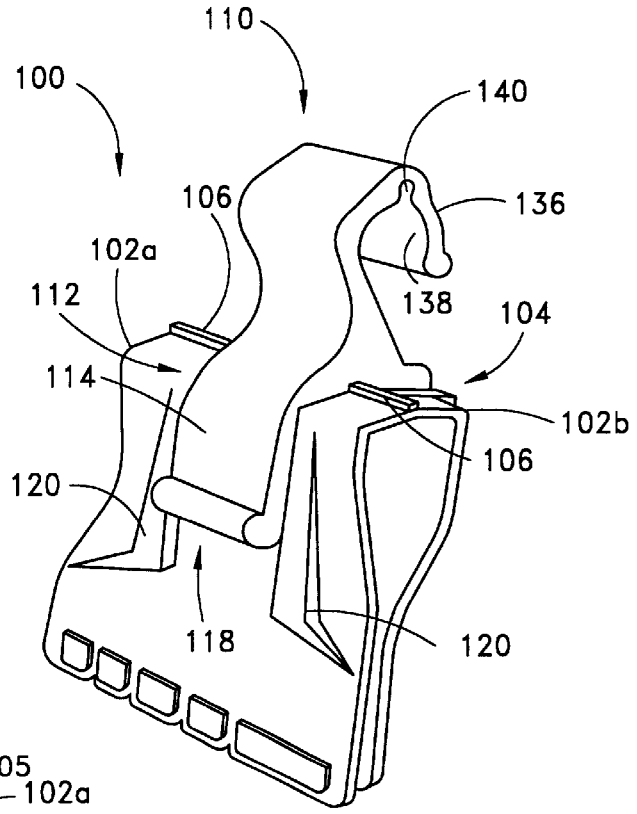
FIG. 1 is a perspective view of a first side of the clothing clip of the present invention.
Figure 2:
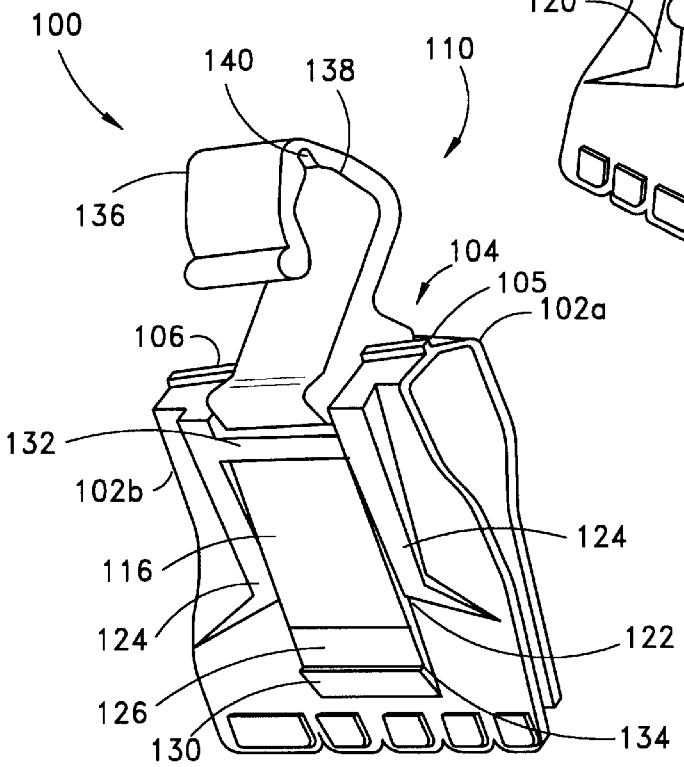
FIG. 2 is a perspective view of a second side of the clothing clip of the present invention.

Reference will now be made to the drawings wherein like numerals refer to like parts. Referring now to FIGS. 1 and 2, a clothing clip device 100 of the present invention is illustrated. The clothing clip device 100 includes a first jaw member 102*a* and a second jaw member 102*b* which are hingedly connected at an upper surface 104 by a pair of hinges 106. In this preferred embodiment, the two jaw members 102*a* and 102*b* are made of plastic and are integrally connected to the hinges 106. The hinges 106 are preferably a "living hinge" comprised of thinner pieces of plastic interposed between the two jaw members 102*a* and 102*b*. The hinges 106 allow the jaw members 102 to move so as to pivot about the hinges 106 between an open and closed position.

The clothing clip 100 of the preferred embodiment also includes a securing member 110. The securing member 110 may be made of the same deformable plastic material as the jaw members 102. Alternatively, in a preferred embodiment, it is a polymer material that is more rigid or durable than the jaw members 102, or that either has a higher modulus of elasticity or is more resistant to permanent deformation. Thus for example, the jaw members 102 may be made of polyethylene, polypropylene, polyethylene terephthalate, acrylonitrile-butadiene-styrene copolymer, or polyvinylchloride, and the spring-like securing member 110 may be made from nylon, teflon, polyoxymethylene, or another engineering polymer. Although metal may be used, it is preferred that both the jaw members 102 and the securing member 110 are formed of injection molded thermoplastic polymer material. The securing member 110 has a substantially U-shaped section 112 that includes a first arm member 114 and a second arm member 116.

The first arm member 114 is preferably shorter than the second arm member 116 for the reasons which are described below. As shown in FIG. 1, the first arm member 114 is positioned so as to slide within a channel 118, formed on an outer surface of the jaw member 102*a*, that is defined by two raised surfaces 120 on the outer surface of the jaw member 102*a*.

Similarly, the second arm member 116 is positioned so as to slide within a channel 122 (FIG. 2) formed on the outer surface of the jaw member 102*b* that is defined by two raised surfaces 124. The second arm member 116 preferably includes an indentation 126 and a raised wedge 130 at the end of the member 116. Further, a bridge member 132 is formed so as to preferably extend between the two raised surfaces 124 in a direction which is substantially perpendicular to the channel 122 at a position which is substantially adjacent the upper surface 104 of the jaw member 102*b*.

The bridge member 132 is thus positioned a first distance from the bottom surface of the channel 122. A back surface 134 of the wedge 130, which is adjacent the indentation 126, extends outward from the second arm 116 a slightly greater distance than the first distance so that the back surface 134 catches on the bridge member 132 when the securing member 110 is slid in the channel 122. This retains the securing member 110 in slidable contact with the two jaw members 102*a* and 102*b* even when the securing member 110 is in an open position (See, FIGS. 5C and 5D).

The securing member 110 also may advantageously also include a generally hook-shaped member 136 which, in this preferred embodiment, is integrally connected to the U-shaped section 112 of the securing member 110. Preferably, the hook-shaped member 136 is configured to define a first indentation 138 that is generally circular in shape with a first radius of curvature. Further, the hook-shaped member 136, in this preferred embodiment is also configured to define a second indentation 140 that is generally circular in shape with a second radius of curvature. The indentations 138 and 140 are used to hang the clothing clip 100 on a hanger or clothesline in the manner that is described in greater detail in reference to FIGS. 6 and 7 below.

Figure 3:
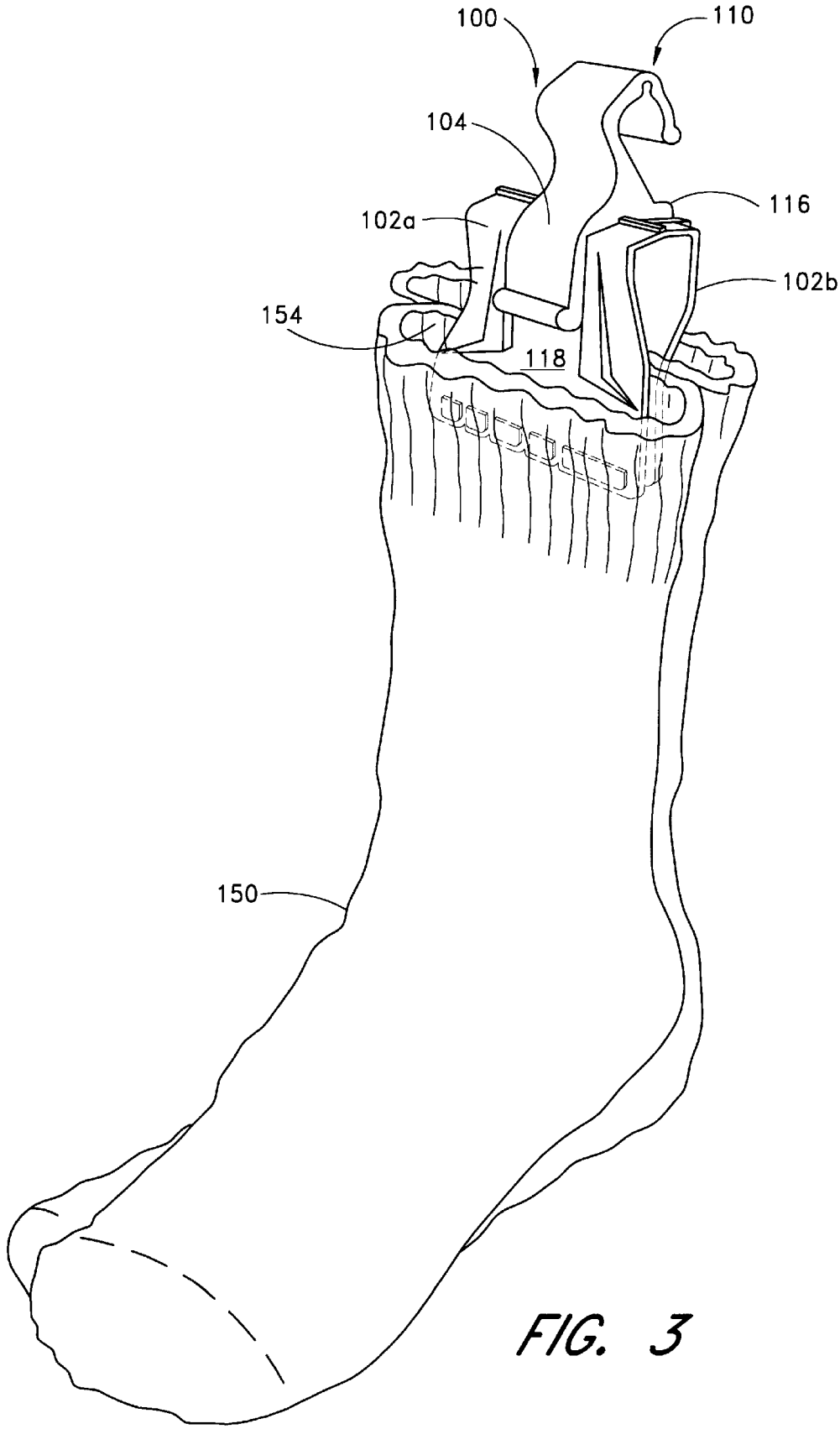
FIG. 3 is a perspective view of the clothing clip of FIGS. 1 and 2 which is securely coupling a pair of socks to each other.
Figure 4:
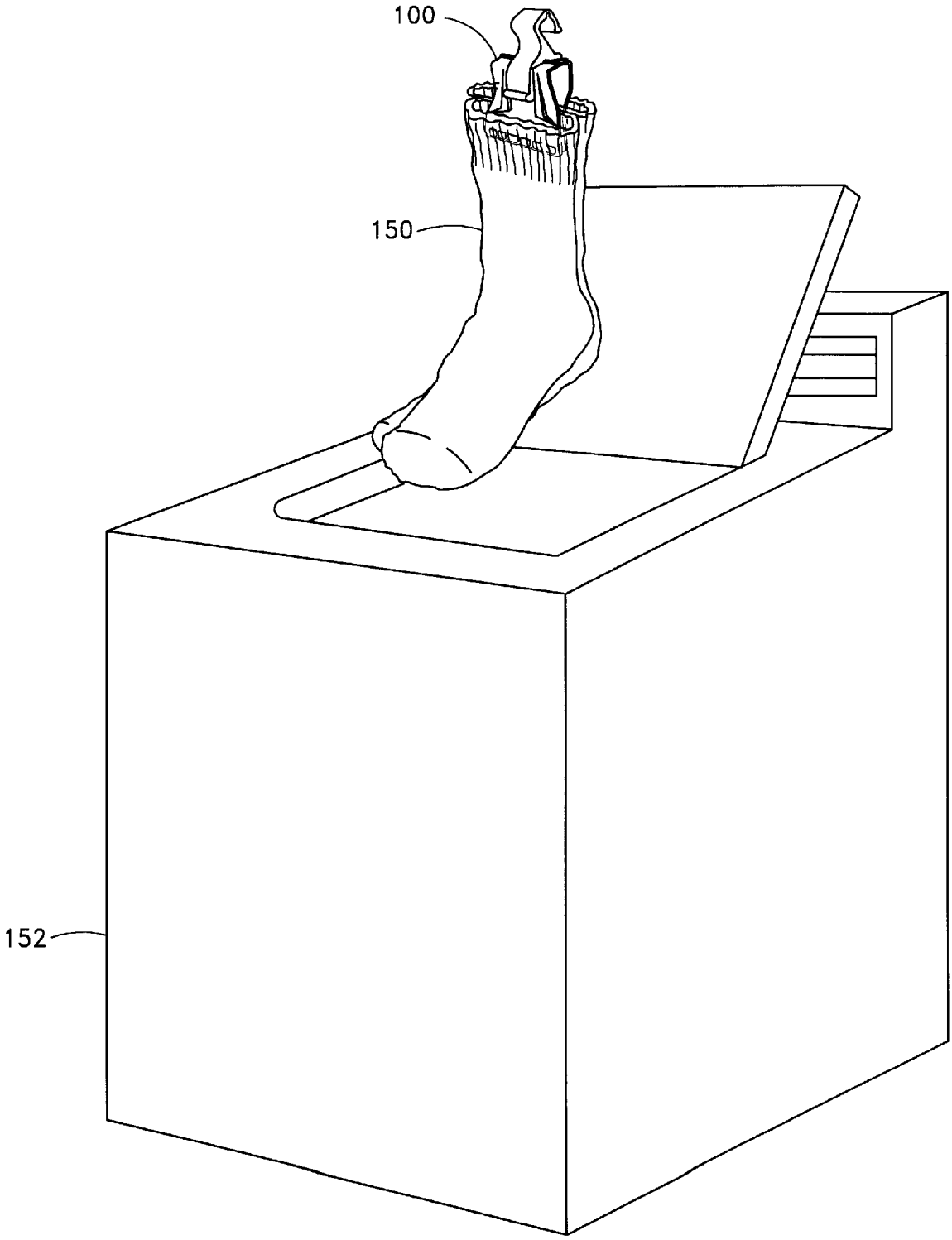
FIG. 4 is a perspective view of the clothing clip and pair of socks in FIG. 3 illustrating that the clip of the present invention can be used in conjunction with a washing machine to wash a pair of socks.

Referring now to FIGS. 3 and 4, the clothing clip 100 of the preferred embodiment is used to couple a pair of socks 150 together prior to and during washing of the socks 150 to ensure that the socks 150 do not become separated. The clothing clip 100 is preferably manufactured of a plastic material which is sufficiently durable and heat resistant to be able to keep the socks 150 coupled together while the socks 150 are being washed in a washing machine 152 and dried in either a dryer or on a clothesline.

As shown in FIG. 3, the neck portion 154 of each of the socks 150 is clamped between the jaw members 102*a* and 102*b*. Specifically, a jaw member 102 is inserted into the opening in each of the socks 150 or over both of the socks 150 while the securing member 110 is in its open configuration (See, FIGS. 5C and 5D). Subsequently, the securing member 110 is moved to a locked position whereby the securing member 110 urges the jaw members 102*a* and 102*b* towards each other thereby clamping the socks 150 between the jaw members 102. Once the socks 150 have been laundered and are ready to be worn, the securing member 110 is then moved into its open configuration and the socks 150 are then removed from the clothing clip 100. Hence, the clothing clip 100 can be used to wash socks in a manner in which the socks are never separated. It can be appreciated that the amount of time spent sorting socks and looking for lost socks after finishing the laundry is eliminated.

Referring now to FIGS. 5A–5D, the open and closed configuration of the clothing clip 100 is illustrated in greater detail. Specifically, referring to FIGS. 5A and 5B, the clothing clip 100 is shown in its closed configuration. In the closed configuration, the securing member 110 is preferably positioned about the jaw members 102*a* and 102*b* whereby the jaw members 102*a* and 102*b* are urged into a position where they are substantially adjacent each other.

Figure 5A:
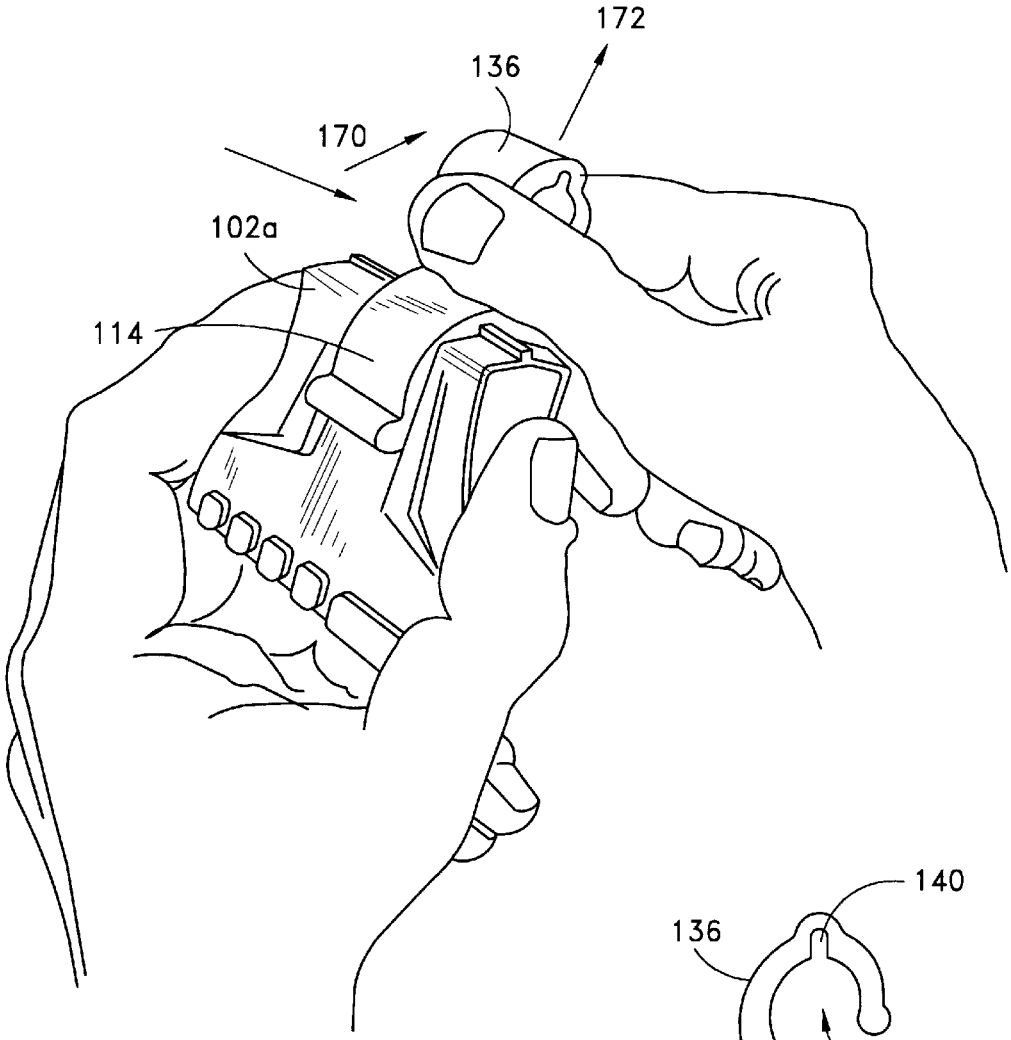
FIG. 5A is a perspective view of the clothing clip of FIG. 1 illustrating how a person would disengage the clip from its closed position.
Figure 5B:
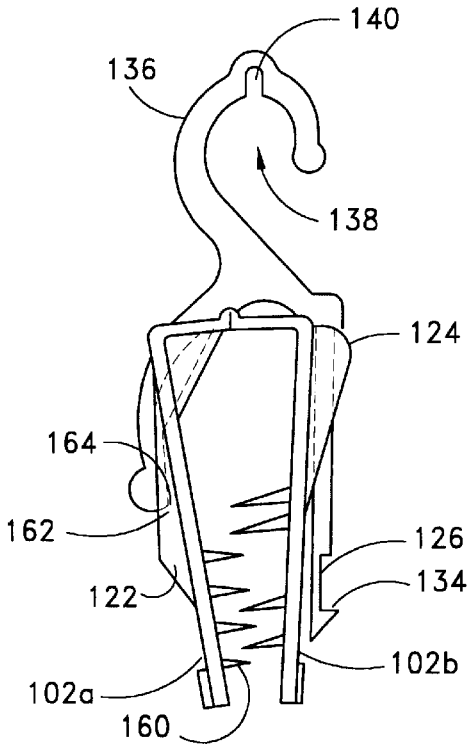
FIG. 5B is a side view of the clothing clip of FIG. 5A further illustrating the component parts of the clip.

FIG. 5B illustrates that the inner surfaces of the jaw members 102*a* and 102*b* each preferably contain a plurality of teeth members 160 which extend inwardly so that the teeth members 160 overlap when the clothing clip 100 is in the closed configuration. When the socks 150 are positioned between the jaw members 102*a* and 102*b*, in the manner illustrated in FIG. 3, the plurality of overlapping teeth members 160 securely couple the socks 150 together to prevent the socks 150 from becoming separated as a result of washing or drying. It can be appreciated that the jaw members 102 can also be configured so that when the clothing clip 100 is in a closed configuration, the jaw members 102 are flush with each other and the socks 150 would thus be coupled together as a result of the inward forces exerted by the jaw members 102*a* and 102*b*.

The securing member 100 is retained in the closed position shown in FIGS. 5A and 5B by the interaction between the lip 162 formed on the inner surface of the first arm member 114 of the securing member 110 and a ridge 164 formed in the channel 118 on the first jaw member 102*a*. Specifically, the lip 162 engages with the ridge 164 to prevent movement of the arm member 114 in the channel 118 and, thus, retain the securing member 110 in a position where it urges the jaw members 102*a* and 102*b* inwardly towards each other.

When the user of the clothing clip 100 wants to remove articles of clothing from the clothing clip 100, the user then manipulates the securing member 110 in the manner shown in FIG. 5A. Specifically, the user exerts a force against the hook portion 136 of the securing member in a direction which is perpendicular to the plane of the first jaw member 102*a* and in the direction of the second jaw member 102*b*, i.e., in the direction of the arrow 170. This results in the lip 162 being urged outward from the channel 118 and disengaging with the ridge 164 formed in the channel 118. Subsequently, the user can then slide the securing member 110 in the direction of the arrow 172 in the open configuration shown in FIGS. 5C and 5D.

Figure 5C:
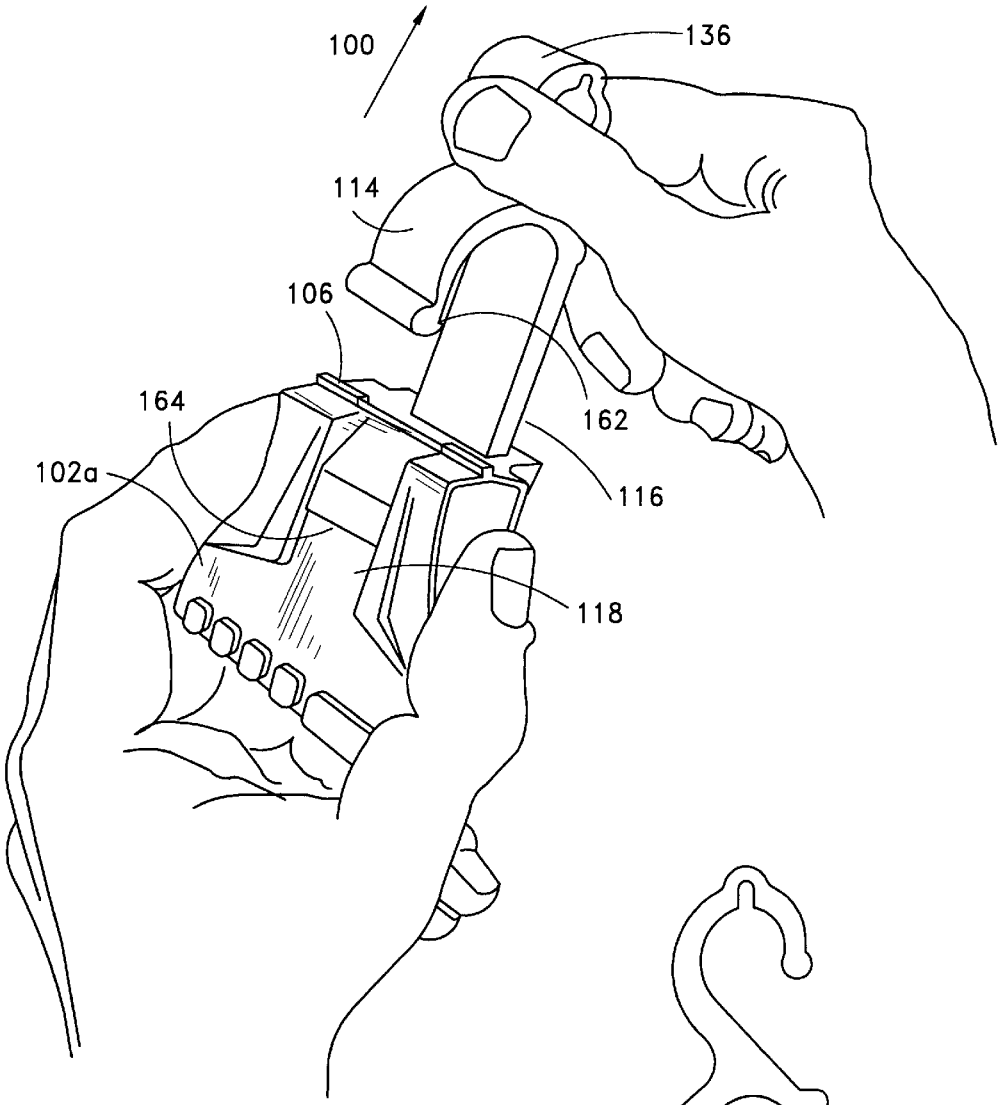
FIG. 5C is a perspective view of the clothing clip of FIG. 5A illustrating the clip in its open position.
Figure 5D:
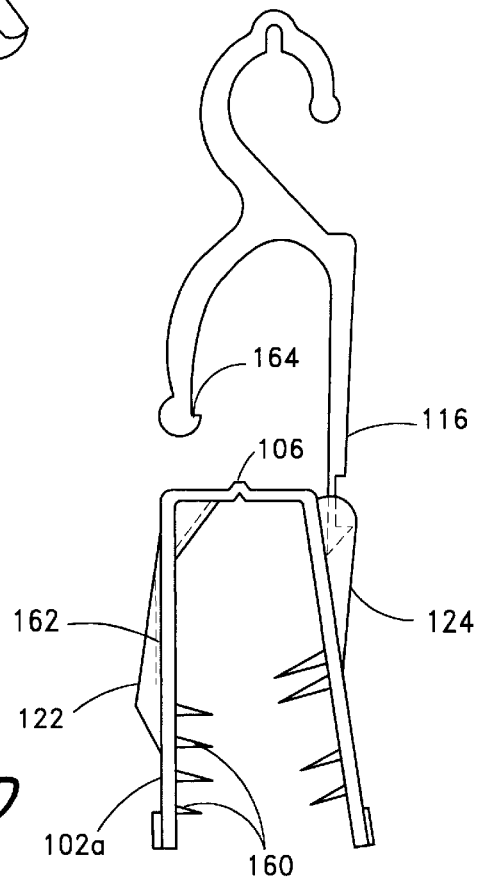
FIG. 5D is a side view of the clothing clip of FIG. 5C illustrating the clip in its open position.

As illustrated in FIGS. 5C and 5D, the first arm member 114 of the securing member 110 is shorter than the second arm member 116. The securing member 110 can be manipulated so that the first arm member 114 slides out of the channel 118 and is no longer in contact with the jaw member 102*a*. As a result, the jaw member 102*a* is no longer biased inwardly towards the jaw member 102*b* and can be swung away from the jaw member 102*b*. Hence, when the user wishes to remove an article of clothing, such as the pair of socks 150, the user simply urges the hook portion 136 of the securing member in the direction of the arrow 170 to disengage the lip 162 from the ridge 164. The user then pulls the securing member 110 upward in the direction of the arrow 180 (FIG. 5C) so that the arm member 114 is no longer adjacent the jaw member 102*b*. The user can then separate the jaw members 102*a* and 102*b* and remove the articles of clothing that were coupled therebetween.

When the clothing clip 100 is in the open position shown in FIGS. 5C and 5D, the second arm member 110 is captured by the bridge member 132 (FIG. 2) on the second jaw member 102*b* so that the securing member 110 is still coupled to the jaw member 102*b*. This allows the clothing clip 100 to be repeatedly reused without having to be reassembled from two separate parts.

Preferably, the securing member 110 is made of a flexible, temperature resistant plastic material which allows the user to repeatedly bend the securing member 110 to disengage the lip 162 and the ridge 164 without permanently deforming the securing member. Thus, the clothing clip 100 can be easily attached to clothing to securely couple separate pieces of clothing together and can also be easily removed from the clothing.

Figure 6:
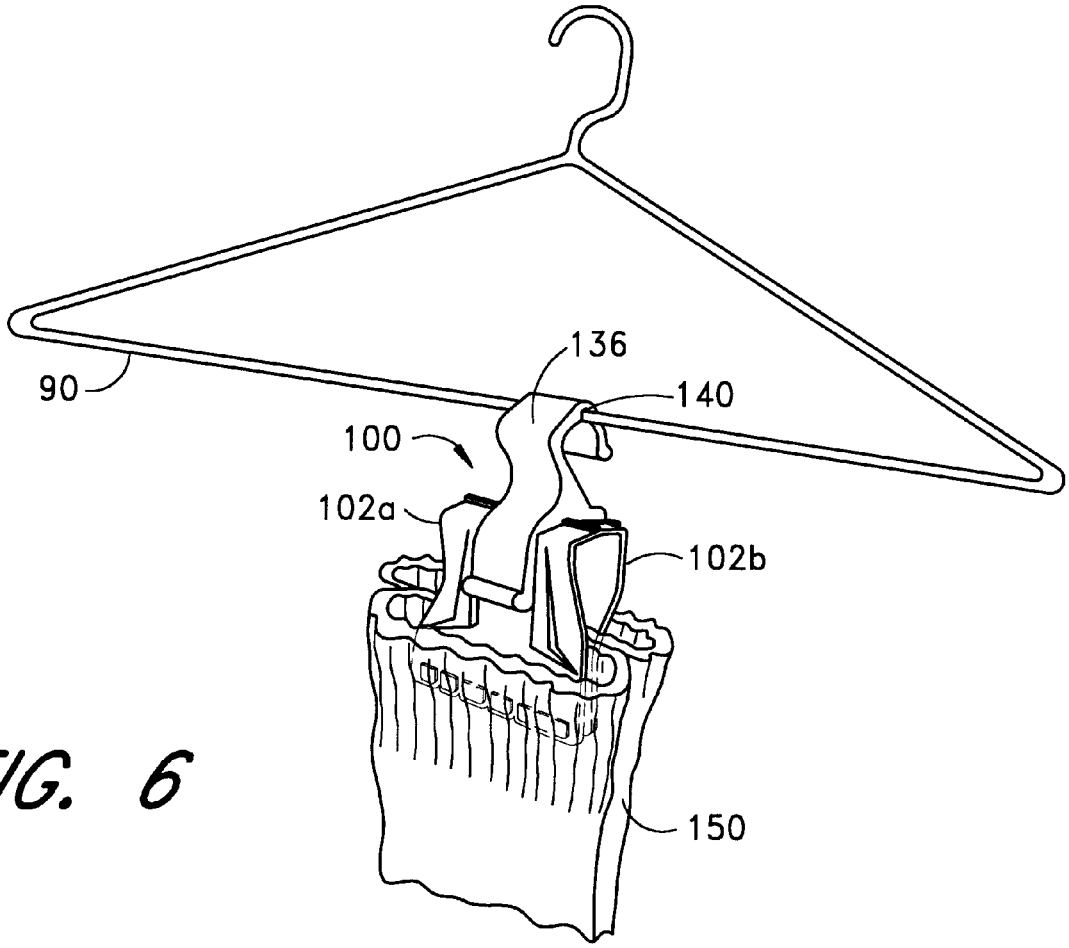
FIG. 6 is a perspective view of the clothing clip of the present invention illustrating that the clip can be mounted on a hanger.
Figure 7:
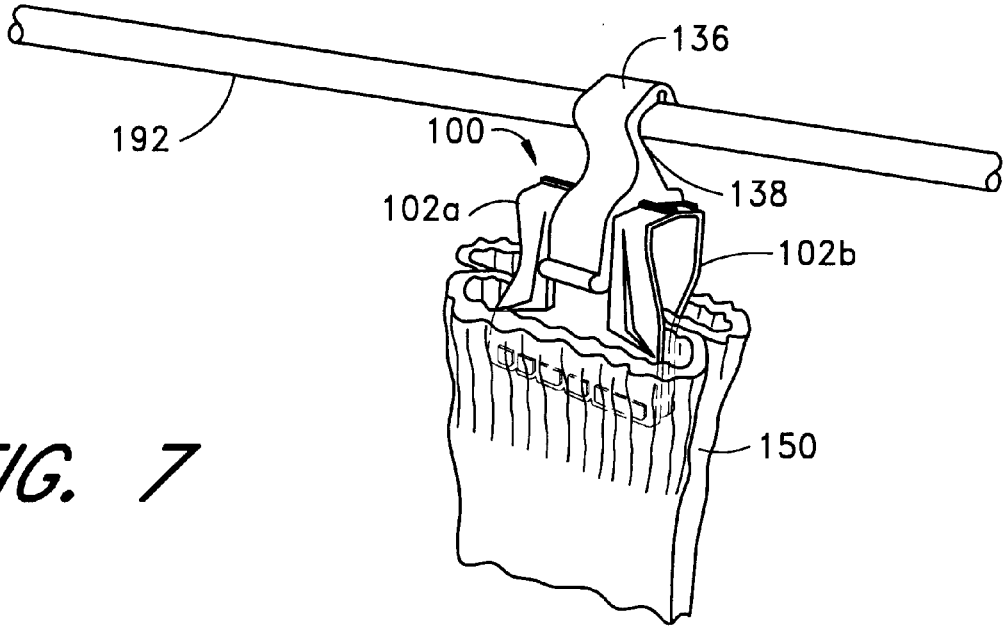
FIG. 7 is a detail view of the clothing clip of FIG. 6 more specifically illustrating that the clip can be mounted on a hanger.

FIGS. 6 and 7 illustrate another unique feature of this embodiment of the clothing clip 100. Specifically, the hook portion 136 of the securing member 110 is preferably configured so that it can be hung on a horizontal support such as a hanger 190 or clothesline 192. The hook-shaped member 136 has two indentations 138 and 140 of two different sizes that extend laterally across the hook portion 136. Hence, the hook portion 136 can be mounted on a substantially horizontal support by simply positioning the horizontal support in one of the indentations.

From the foregoing description, one can appreciate that the clothing clip can be used to couple articles of clothing, and in particular pairs of socks, together so that when the articles of clothing are washed they do not become separated. Once the washing is completed, the articles of clothing can be stored still coupled together by the clothing clip. Further, the articles of clothing can also be hung on a horizontal support such as a hanger or clothesline due to the hook-shaped portion of the securing member. When a person wishes to wear the article of clothing he or she simply has to disengage the securing member from the jaw member and move the securing member into a position where the jaws can be separated and then remove the articles of clothing from the clothing clip. Hence, the clothing clip of the present invention provides a convenient, inexpensive device for coupling clothing together to minimize the amount of time spent sorting the clothing and to prevent loss of articles of clothing. A method of the present invention therefore comprises securing two articles of clothing together (e.g., socks) connected with the previously-described clip 100, washing the clothing, drying the clothing in a dryer or on a clothes line, and then removing the intact combination of clothing and clip from the dryer.

Although the foregoing description of the preferred embodiment of the present invention has shown, described and pointed out the fundamental novel features of the invention, it will be understood that various omissions, substitutions, and changes in the form of the detail of the apparatus as illustrated, as well as the uses thereof, may be made by those skilled in the art, without departing from the spirit of the present invention. Consequently, the scope of the invention should not be limited to the foregoing discussion, but should be defined by the appended claims.

What is claimed is:

1. A system for washing two or more articles of clothing, comprising:

first and second jaw members which are hingeably connected;

a securing member which is operably engaged with said first and said second jaw members so that said securing member can be positioned in an open position, wherein said first and second jaw members can be separated, and in a closed position wherein said first and said second jaw members are urged towards each other and thereby securely clamp two articles of clothing therebetween with sufficient strength to hold them together throughout a wash cycle of a washing machine;

a latching mechanism engaged with said securing member and at least one of said first and second jaw members so as to latch said securing member in said closed position wherein said first and second jaw members, said securing member, and said latching mechanism are all formed of plastic;

a hook which is connected to said securing member, wherein said hook is configured to securely mount on a horizontal member having a first diameter, and wherein said hook member is configured to securely mount on either a horizontal member having a first diameter or a horizontal member having a different, second diameter, wherein said horizontal member having a first diameter comprises a horizontal section of a clothes hanger and wherein said horizontal member having a second diameter comprises a clothes line, and two articles of clothing securely retained between said first and said second jaw members.

2. A system for washing two or more articles of clothing, comprising:

first and second jaw members which are hingeably connected;

a securing member which is operably engaged with said first and said second jaw members so that said securing member can be positioned in an open position, wherein said first and second jaw members can be separated, and in a closed position wherein said first and said second jaw members are urged towards each other and thereby securely clamp two articles of clothing therebetween with sufficient strength to hold them together throughout a wash cycle of a washing machine, wherein a first channel is defined on the outer surface of said first jaw member and a second channel is defined on the outer surface of said second jaw member and said securing member includes a first arm and a second arm which are configured so that said first arm and said second arm are slidably engaged in said first and said second channels respectively, wherein said first arm of said securing member is shorter than said second arm and said second arm is captured in said second channel so that when said securing member is in said open position, said first arm is removed from said first channel and a portion of said second arm is securely retained in said channel;

a latching mechanism engaged with said securing member and at least one of said first and second jaw members so as to latch said securing member in said closed position wherein said first and second jaw members, said securing member, and said latching mechanism are all formed of plastic; and two articles of clothing securely retained between said first and said second jaw members.

3. The system of claim 2, wherein said latching mechanism is comprised of a ridge positioned in said first channel that engages with a lip positioned on said first arm so as to retain said first arm in a first position in said channel thereby retaining said securing member in said closed position.

4. The system of claim 3, wherein said securing member is formed out of a deformable material which allows a user to disengage said lip on said first arm and said ridge in said channel by exerting a force against a first portion of said securing member to induce a second portion of said first arm adjacent said lip to move outward away from said first channel to thereby disengage said lip from said ridge to allow said securing member to be moved to said open position.

* * * * *